US005647192A

United States Patent [19]

Kivits et al.

[11] Patent Number: 5,647,192

[45] Date of Patent: Jul. 15, 1997

[54] FOLDING ELEMENT SUITABLE FOR USE IN A PACKAGING APPARATUS, PACKAGING APPARATUS COMPRISING SUCH FOLDING ELEMENT, AND METHOD FOR THE USE THEREOF

[75] Inventors: Petrus Franciscus Kivits, Schiedam; Roberto Tuyn, Zaandam, both of Netherlands

[73] Assignee: Buhrs-Zaandam B.V., Zaandam, Netherlands

[21] Appl. No.: 466,190

[22] Filed: Jun. 6, 1995

[30] Foreign Application Priority Data

Jun. 6, 1994 [NL] Netherlands ..... 9400915

[51] Int. Cl.[6] ..... B65B 9/06

[52] U.S. Cl. ..... 53/450; 53/550

[58] Field of Search ..... 53/450, 550, 548, 53/464, 223

[56] References Cited

U.S. PATENT DOCUMENTS

| | | | |
|---|---|---|---|
| 516,186 | 3/1894 | Crowell | 53/550 X |
| 3,016,667 | 1/1962 | Kerhoas | 53/550 |
| 3,532,516 | 10/1970 | Erekson | 53/550 X |
| 3,553,933 | 1/1971 | Seko | 53/550 |
| 4,546,595 | 10/1985 | Yasumune et al. | 53/450 |
| 4,679,379 | 7/1987 | Cassoli | 53/450 X |
| 5,408,806 | 4/1995 | Lin et al. | 53/550 |

*Primary Examiner*—James F. Coan

*Attorney, Agent, or Firm*—Griffin, Butler, Whisenhunt & Kurtossy

[57] ABSTRACT

Folding element (1) suitable for use in a packaging apparatus in which in operation a strip of packaging material (7) to be fed continuously is guided from a feeding direction over the folding element (1) and, while a shell is formed from the material strip, is guided further from the folding element in a product conveying direction, with the feeding direction and the product conveying direction including an angle. The folding element (1) comprises a front face (12) extending in the feeding direction and a top face (17) extending in the product conveying direction, over which front and top faces (12, 17) the material strip (7) moves in operation, the front face (12) being bounded on opposite sides by a fold forming edge (13) which intersects the intersecting line of the front and top faces (12, 17) in a folding point, in which folding point in operation folds are formed in the material strip (7). A packaging apparatus comprising such folding element (1).

16 Claims, 4 Drawing Sheets

FOLDING ELEMENT SUITABLE FOR USE IN A PACKAGING APPARATUS, PACKAGING APPARATUS COMPRISING SUCH FOLDING ELEMENT, AND METHOD FOR THE USE THEREOF

BACKGROUND OF THE INVENTION

This invention relates to a folding element suitable for use in a packaging apparatus in which in operation a strip of packaging material to be fed continuously is guided from a feeding direction over the folding element and, while a shell is formed from the material strip, is guided further from the folding element in a product conveying direction, with the feeding direction and the product conveying direction including an angle.

Such a packaging apparatus with a folding element is disclosed in European patent application 0 526 944, where a strip of packaging material is passed over a folding element and formed into a flat shell. The known folding element comprises a middle portion of a cylindrical shape blending at the two ends into cone-shaped folding shoulders.

A disadvantage of this folding shoulder is that after the folding element the folded sides or turnover widths of the strip incline towards each other over an acute angle. This is the result of the fact that this known folding element does not make sharp folds in the material strip. As a consequence, additional aids are needed to hold the folded sides above the folding element, so that a sufficiently large opening is created to be able to place the products to be packaged on the strip of packaging material. Because after folding the folded sides incline towards each other over an acute angle, in practice the folds are provided farther away from the product in order to create a sufficiently large opening. However, this entails the disadvantage that the required width of the strip of packaging material is wider than is strictly necessary, which renders the package more expensive. Moreover, the package of the products is wider than is necessary and, as a result, the products lying loosely in the package may shift within the package, so that they may be damaged.

The object of the invention is to provide a folding element by means of which sharper folds can be provided in the material strip, without requiring aids for holding the folded sides and by means of which folds can be provided closer to the product to be packaged.

SUMMARY OF THE INVENTION

This object is achieved in accordance with the invention in that the folding element comprises a front face extending in the feeding direction and a top face extending in the product conveying direction, over which front and top faces the material strip moves in operation, the front face being bounded on opposite sides by a fold forming edge which intersects the intersecting line between the front and top face in a folding point, in which folding point in operation folds are formed in the material strip.

As a result, after folding, the folded sides of the strip of packaging material do not incline towards each other at an acute angle but the folded sides are more or less upright. This is because the folds in the material strip only arise in the intersecting line of the front face and the top face of the folding element.

This requires no additional aids for keeping an infeed opening of the folded shell open, and a sufficiently large infeed opening remains clear between the folded sides of the material strip for the infeed of the products to be packaged.

Because the folded sides are more or less vertically oriented, the folds can be provided closer to the product. As a result, the strip of packaging material may be less wide, which yields a saving of the required packaging material. Moreover, the packaging material is now tightly folded around the product, so that the product cannot shift within the package and so cannot be damaged.

According to a preferred embodiment of the invention, the folding element comprises two folding shoulders each adjoining a fold forming edge, which folding shoulders together with the front face form a convex front side as viewed in top plan view. The folding shoulders support the side edges of the material strip to be folded during folding.

Because the folds arise at the location of the point where the fold forming edge intersects the intersecting line of the front face and the top face, the width of the front face of the folding element approximately corresponds with the width of the products to be packaged.

When using a folding element with folding shoulders according to the invention, both paper and plastic packaging materials can be used. Plastic in particular is soft and should be supported throughout the width. Therefore the width of the folding shoulders should at least correspond with the maximum width of a folded side or to the turnover width of a strip of packaging material.

In accordance with an advantageous embodiment of the folding element according to the invention, the folding element is dividable in two parts, while a filler piece can be arranged to widen the front face for packaging wider products. As a result, the folding element can be rapidly converted for packaging products of a different width.

In accordance with a further advantageous embodiment of the folding element according to the invention, the folding shoulders are pivotally mounted with respect to the front face of the folding element. In this manner, the width of the folded sides can be adjusted and hence the position where the longitudinal seam of the package is provided.

In a preferred embodiment of the folding element according to the invention, the folding shoulders have a convex shape in top plan view. In particular with plastic packaging material, in this way the material strip is properly supported during folding throughout the width of the material strip and not locally stretched.

The invention also relates to a packaging apparatus comprising a folding element according to the invention, in which the top face of the folding element is arranged in a plane parallel to the product conveying direction, while the front face extends perpendicularly to the product conveying direction.

As a result, after folding, the folded sides of the strip of packaging material do not incline towards each other at an acute angle but the folded sides are oriented more or less vertically. This is because the folds in the material strip do not arise until in the intersecting line of the front face and the top face of the folding element.

It has been found that the curve of the convex folding shoulders should be chosen in accordance with the dimensions and construction of the folding apparatus. In particular, the curve of the convex folding shoulder is dependent on the angle between the feeding direction and the product conveying direction of the material strip, in such a manner that the tensile stress is the same throughout the width of the material strip. The angle is preferably about 90°, so that, viewed in the product conveying direction, a compact construction of the packaging apparatus can be realized, since the required distance for feeding the material strip corresponds approximately with the dimension of the folding element in the product conveying direction.

It has further been found that the curve of the convex folding shoulders is independent of the turnover width of the strip of packaging material. Therefore the width of the folded sides can be simply adjusted and the position where the longitudinal seam of the package is provided can be varied without requiring the use of a differently shaped folding shoulder.

It has moreover been found that the initial angle of the folding shoulder relative to the front face increases according as the turnover width of the strip of packaging material is greater. If the folding shoulders are pivotally mounted with respect to the front face of the folding element, the turnover width can be modified quickly and simply by adjusting the initial angle of the folding shoulder.

The invention further relates to a method for folding into a shell a strip of packaging material to be fed continuously, in which the strip of packaging material is guided from the underside in a feeding direction over a folding element and, while the shell is being formed from the material strip, is guided further from the folding element in a product conveying direction, while during folding the products to be packaged are placed on the material strip between the folded sides of the material strip, the folding element comprising a front face extending in the feeding direction and a top face extending in the product conveying direction, while the top face of the folding element is arranged in a plane parallel to the product conveying plane, the front face extends perpendicularly to the product conveying direction, the front face being bounded on opposite sides by a fold forming edge which intersects the intersecting line of the front and top faces in a folding point, in which folding point in operation folds are formed in the material strip.

As a result, the folds do not arise until in the product conveying plane at the location of the top side of the folding element and after folding the folded sides of the strip of packaging material are not oriented towards each other at an acute angle but the folded sides are more or less upright. Before the folding element, the strip of packaging material continues to travel more or less in one and the same plane, so that the required space for feeding the strip of packaging material is limited.

BRIEF DESCRIPTION OF THE DRAWINGS

Embodiments of the folding element according to the invention are further explained with reference to the drawings. In the drawings.

DESCRIPTION OF PREFERRED EMBODIMENTS

Figure 1:
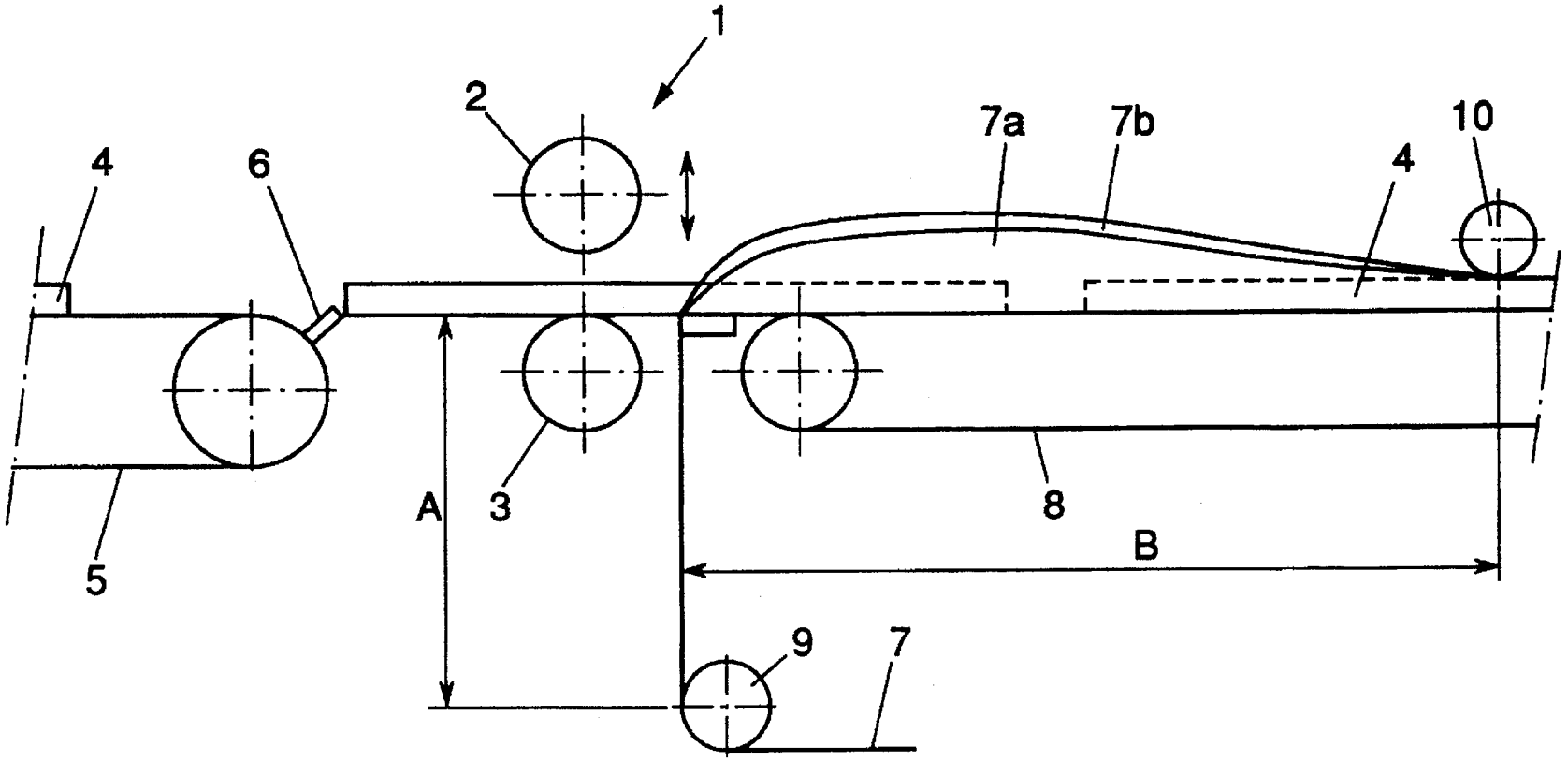
FIG. 1 is a diagrammatic side elevation of a packaging apparatus comprising a folding element according to the invention.

FIG. 1 diagrammatically shows a side elevation of a packaging apparatus with a folding element 1 according to the invention. The strip of packaging material 7 is guided from a supply roll (not shown) from the underside via at least one diverting roller 9 towards the folding element 1. The products 4 to be packaged are fed via a conveyor 5, which comprises push-up projections 6, to a set of feed rollers 2, 3. These feed rollers 2, 3 position the products at a particular interval on the strip of packaging material 7 between the upright sides **7*a* and 7*b*. The package is closed entirely by a closing roller 10, which cooperates with a conveyor 8. The conveyor 8** conveys the packaged products further in the packaging apparatus.

Figure 2:
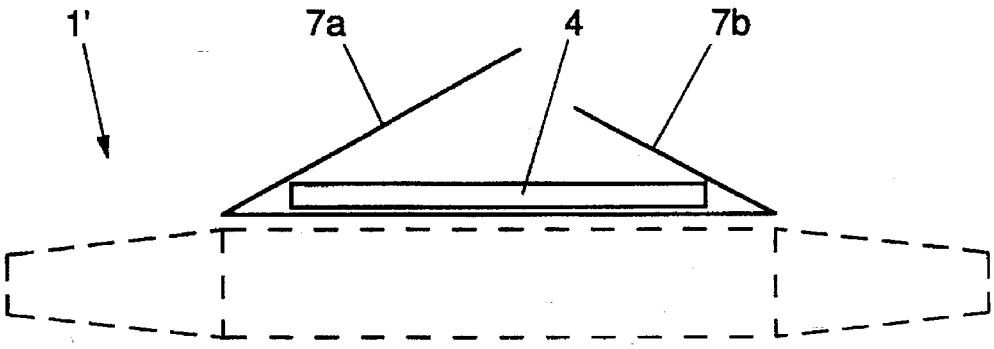
FIG. 2 is an open package with the folds provided by means of a known folding element depicted by broken lines.

A known folding element 1' which is normally used, is shown in FIG. 2. The central portion thereof is cylindrical and merges on opposite sides into a conical portion. After folding over this folding element 1', the folded sides **7*a* and 7*b* lean towards each other through an acute angle. As a result, the infeed opening for introducing the products 4 to be packaged is not large enough. As a consequence, additional aids (not shown) are needed to receive the folded sides above the folding element, so that the products 4 to be packaged can be placed on the strip of packaging material 7** without any problems.

Figure 3:
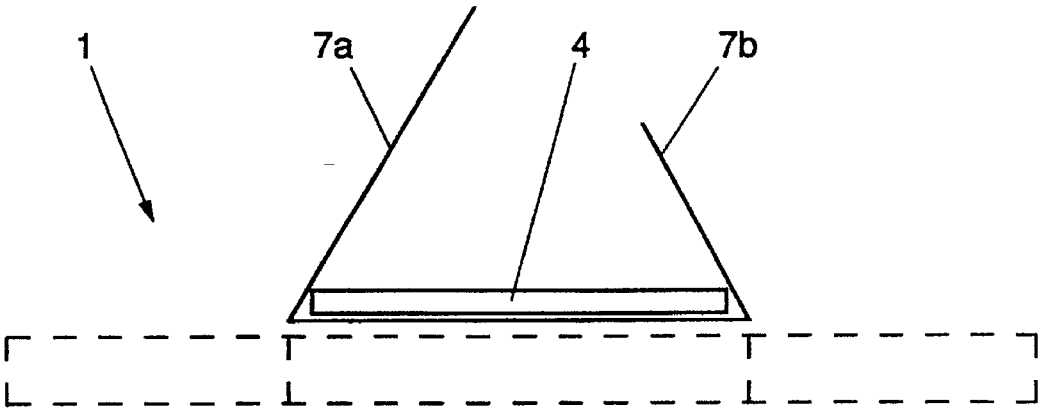
FIG. 3 is an open package with the folds provided by means of a folding element according to the invention depicted by broken lines.
Figure 4A:
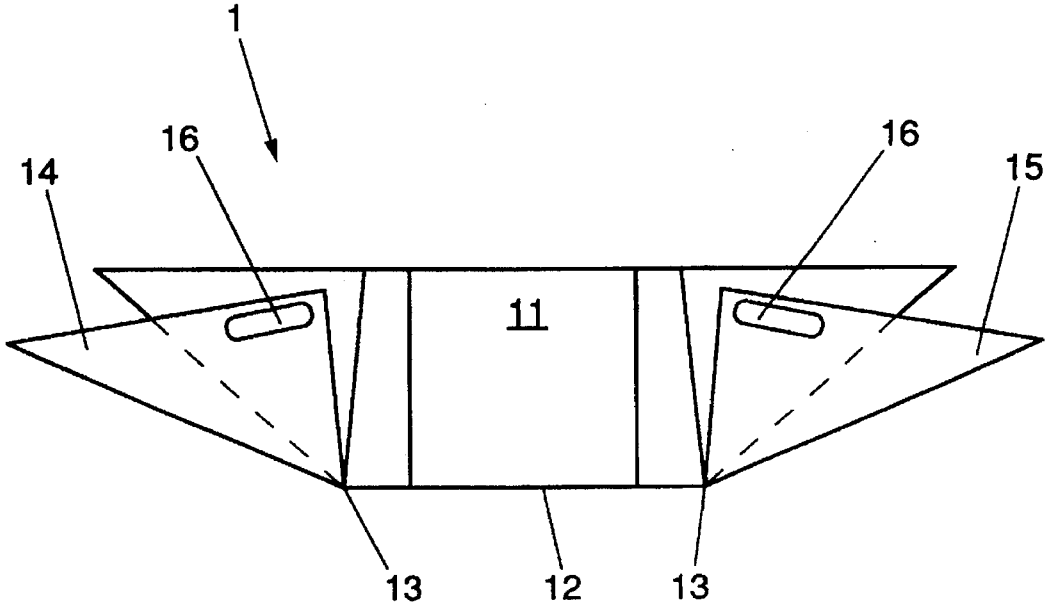
FIG. 4 shows a diagrammatic top and front view of an embodiment of the folding element according to the invention.
Figure 4B:
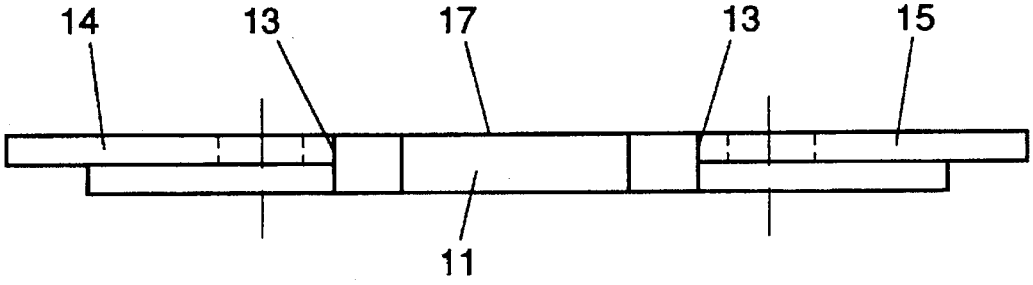
Figure 5A:
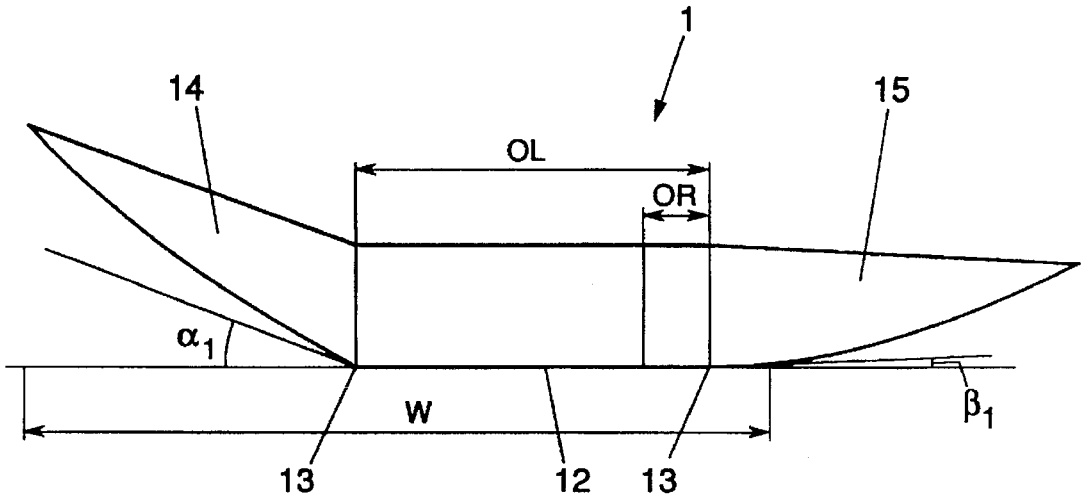
FIG. 5 shows three top plan views of a folding element according to the invention, with the folding shoulders having a convex shape and different initial angles.
Figure 5B:
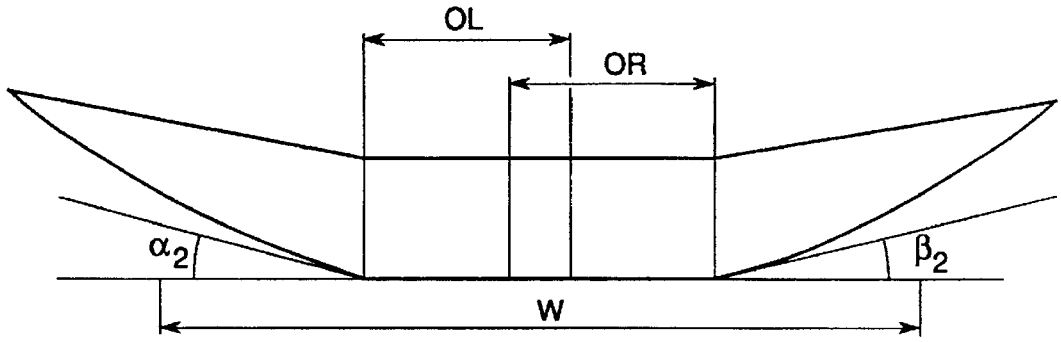
Figure 5C:
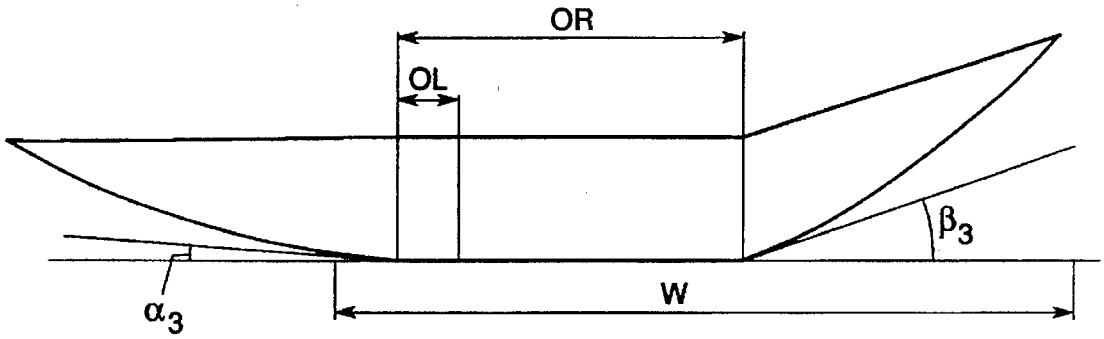

FIG. 3 shows in broken lines the front view of a folding element 1 according to the invention. Depicted thereabove is an open package whose folds have been formed with a folding element according to the invention. The folded sides **7*a* and 7*b* of the material strip 7 are here oriented substantially straight up. As a result, a sufficiently large infeed opening is present for introducing the products 4 to be packaged. Moreover, the folds can be provided directly adjacent to the product 4. As a consequence, the width of the material strip 7 can be limited to about twice the width of a product to be packaged plus the width of the overlap of the sides 7*a* and 7*b*** when entirely folded.

An example of a folding element 1 according to the invention is shown in FIGS. **4*a* and 4*b*. The folding element 1 is divided and comprises a filler piece 11. Thus the folding element 1 can be rapidly converted for packaging products 4 of a different width. The folding element comprises a straight front face 12 ending laterally in a fold forming edge 13**.

The folding element 1 comprises two pivotally mounted folding shoulders 14, 15. The initial angle of the folding shoulders 14, 15 with respect to the front face 12 of the folding element 1 can thereby be changed, which is indicated schematically by a slot 16 in the folding shoulders 14, 15. The front side of the folding shouders 14, 15 is straight in top plan view, since this folding element 1 is intended for folding a material strip of paper. Since paper has some natural rigidity, only the part in the proximity of the fold forming edge 13 is of interest and the side to be folded over need not be supported throughout the width. The top side of the folding shoulders 14, 15 is situated in the same plane as the top face 17 of the folding element 1.

For folding plastic packaging material, FIGS. **5*a*, 5*b* and 5*c* diagrammatically show three top plan views of a folding element 1 according to the invention. In order that the sides to be folded are fully supported during folding, the folding shoulders 14, 15 have a convex shape. The initial angle $\alpha,\beta$ of the folding shoulder 14, 15 depends on the turnover width OR, OL. The initial angle $\alpha,\beta$ should be chosen depending on the position of the longitudinal seam or the overlapping part of the folded sides 7*a*, 7*b* of the material strip 7. Moreover, as a consequence, the position of supplied material strip 7 relative to the folding element 1 is different. The width W of the supplied material strip 7** remains the same.

The object of the invention is to provide a folding element 1 by means of which sharper folds can be made in the material strip 7 without requiring any aids for holding the folded sides 7*a*, 7*b* and by means of which the folds can be provided closer to the product 4 to be packaged.

This object is achieved in accordance with the invention in that the folding element 1 comprises a front face 12 extending in the feeding direction and a top face 17 extending in the product conveying direction, over which front and top faces 12, 17 the material strip 7 moves in operation, the front face 12 being bounded on opposite sides by a fold forming edge 13 which intersects the intersecting line of the front and top faces 12, 17 in a folding point, in which folding point in operation folds are formed in the material strip 7.

As a result, after folding, the folded sides 7*a*, 7*b* of the strip of packaging material 7 do not lean towards each other at an acute angle but the folded sides 7*a*, 7*b* are more or less vertical. This is because the folds in the material strip 7 do not arise until in the intersecting line of the front face 12 and the top face 17 of the folding element 1.

This requires no additional aids for keeping clear an infeed opening of the formed shell, a sufficiently large infeed opening being maintained between the folded sides 7*a*, 7*b* of the material strip 7 for the infeed of the products 4 to be packaged. Because the folded sides 7*a*, 7*b* are more or less upright, the folds can be made closer to the product 4. As a result, the strip of packaging material 7 can be less wide, yielding a saving of the packaging material required. Moreover, the packaging material is now folded tightly about the product 4, so that the product 4 cannot shift within the package and thereby be damaged.

According to a preferred embodiment of the invention, the folding element 1 comprises two folding shoulders 14, 15 each adjoining a fold forming edge 13, which folding shoulders 14, 15, together with the front face 12, form a convex front side in top plan view. The side edges 7*a*, 7*b* of the material strip 7 to be folded are supported by the folding shoulders 14, 15 during folding.

Because the folds arise at the location of the point where the fold forming edge 13 intersects the intersecting line of the front face 12 and the top face 17 of the folding element 1, the width of the front face 12 of the folding element 1 corresponds approximately to the width of the products 4 to be packaged.

When using a folding element 1 with folding shoulders 14, 15 according to the invention, both paper and plastic packaging materials can be used. Plastic in particular is soft and should be supported throughout the width. Therefore the width of the folding shoulders 14, 15 should at least correspond to the maximum width of a folded side or to the turnover width 7*a*, 7*b* of a strip of packaging material 7.

According to an advantageous embodiment of the folding element 1 according to the invention, the folding element 1 is dividable in two parts, while a filler piece 11 can be arranged to widen the front face for packaging wider products 4. As a result, the folding element 1 can be rapidly converted for packaging products 4 of a different width.

In accordance with a further advantageous embodiment of the folding element 1 according to the invention, the folding shoulders 14, 15 are pivotally mounted with respect to the front face 12 of the folding element 1. In this manner, the width of the folded sides 7*a*, 7*b* can be adjusted and hence the position where the longitudinal seam of the package is provided.

In a preferred embodiment of the folding element 1 according to the invention, the folding shoulders 14, 15 have a convex shape in top plan view. In particular with plastic packaging material, in this way the material strip 7 is properly supported during folding throughout the width of the material strip 7 and not locally stretched.

The invention also relates to a packaging apparatus comprising a folding element 1 according to the invention, in which the top face 17 of the folding element 1 is arranged in a plane parallel to the product conveying plane, while the front face 12 extends perpendicularly to the product conveying direction.

As a result, after folding, the folded sides 7*a*, 7*b* of the strip of packaging material 7 do not lean towards each other at an acute angle but the folded sides 7*a*, 7*b* are oriented more or less vertically. This is because the folds in the material strip 7 only arise in the intersecting line of the front face 12 and the top face 17 of the folding element 1.

It has been found that the curve of the convex folding shoulders 14, 15 should be chosen in accordance with the dimensions and construction of the folding apparatus. In particular the curve of the convex folding shoulder 14, 15 is dependent on the angle between the feeding direction and the product conveying direction of the material strip 7, in such a manner that the tensile stress is the same throughout the width W of the material strip 7. The angle is preferably about 90°, so that, viewed in the product conveying direction, a compact construction of the packaging apparatus can be realized, since the required distance for feeding the material strip 7 approximately corresponds to the dimension of the folding element 1 in the product conveying direction.

It has further been found that the curve of the convex folding shoulder 14, 15 is independent of the turnover width 7*a*, 7*b* of the strip of packaging material 7. Therefore the width of the folded sides 7*a*, 7*b* can be simply adjusted and the position where the longitudinal seam of the package is provided can be varied without requiring the use of a differently shaped folding shoulder 14, 15.

It has moreover been found that the initial angle $\alpha,\beta$ of the folding shoulder 14, 15 relative to the front face 12 increases according as the turnover width 7*a*, 7*b* of the strip of packaging material 7 is greater. If the folding shoulders 14, 15 are pivotally mounted with respect to the front face 12 of the folding element 1, the turnover width 7*a*, 7*b* can be modified quickly and simply by adjusting the initial angle $\alpha,\beta$ of the folding shoulder 14, 15.

The invention further relates to a method for folding into a shell a strip of packaging material 7 to be fed continuously, in which the strip of packaging material 7 is guided from the underside in a feeding direction over a folding element 1 and, while the shell is formed from the material strip 7, is guided further from the folding element 1 in a product conveying direction, while during folding the products 4 to be packaged are placed on the material strip 7 between the folded sides 7*a*, 7*b* of the material strip 7, the folding element 1 comprising a front face 12 extending in the feeding direction and a top face 17 extending in the product conveying direction, the top face 17 of the folding element 1 being arranged in a plane parallel to the product conveying plane, the front face 12 extending perpendicularly to the product conveying direction, the front face 12 being bounded on opposite sides by a fold forming edge 13 which intersects the intersecting line of the front and top faces 12, 17 in a folding point, in which folding point in operation folds are formed in the material strip 7.

As a result, folds do not arise until in the product conveying plane at the location of the top side of the folding element 1 and after folding the folded sides 7*a*, 7*b* of the strip of packaging material 7 do not lean towards each other at an acute angle but the folded sides 7*a*, 7*b* are oriented more or less straight up. Before the folding element 1 the strip of packaging material 7 continues to travel more or less in one and the same plane, so that the required space for feeding the strip of packaging material 7 is limited.

We claim:

1. In a folding element suitable for use in a packaging apparatus in which a continuous packaging material strip is guided from a feeding direction over a folding element to form a shell from the material strip, and the shell is guided from the folding element in a product conveying direction, with the feeding direction and the product conveying direction including an angle, the improvement comprising a front face (12) extending in the feeding direction and a top face (17) extending in the product conveying direction such that the material strip is movable over the front and top faces (12, 17), the front face (12) being bounded on opposite sides by a fold forming edge (13) which intersects an intersecting line between the front and top faces (12, 17) at a folding point where folds are formed in the material strip (7).

2. A folding element according to claim 1, wherein two folding shoulders (14, 15) each adjoin the fold forming edge (13) and wherein the folding shoulders (14, 15) together with the front face (12) form a convex front side in top plan view.

3. A folding element according to claim 1, wherein the width of the front face (12) approximately corresponds with the width of products (4) to be packaged.

4. A folding element according to claim 2, wherein a width of the folding shoulders (14, 15) corresponds at least with a maximum width of a folded side or with a turnover width (7*a*, 7*b*) of the strip.

5. A folding element according to claim 1, wherein the folding element (1) is dividable in two parts between which a filler piece (11) is arrangeable to widen the front face (12) for packaging wider products (4).

6. A folding element according to claim 2, wherein the folding shoulders (14, 15) are pivotally mounted with respect to the front face (12) of the folding element (1).

7. A folding element according to claim 2, wherein the folding shoulders (14, 15) have a convex shape in top plan view.

8. A packaging apparatus comprising a folding element according to claim 1, wherein the top face (17) of the folding element (1) is arranged in a plane parallel to a product conveying plane, with the front face (12) extending perpendicularly to the product conveying direction.

9. A packaging apparatus comprising a folding element according to claim 7, wherein the curve of the convex shape of the folding shoulders (14, 15) is dependent on dimensions of the packaging apparatus, in such a manner that the tensile stress is the same throughout a width (W) of the material strip (7).

10. A packaging apparatus according to claim 9, wherein the curve of the convex folding shoulder (14, 15) is dependent on an angle between the feeding direction and the product conveying direction of the material strip (7).

11. A packaging apparatus according to claim 10, wherein the angle between the feeding direction and the product conveying direction is about 90°.

12. A packaging apparatus according to claim 9, wherein the curve of the convex folding shoulders (14, 15) is dependent on a distance (A) between the folding element (1) and a last diverting roller (9) under the folding element (1).

13. A packaging apparatus according to claim 9, wherein the curve of the convex folding shoulder (14, 15) is dependent on a distance (B) between the folding element (1) and a closing roller (10).

14. A packaging apparatus according to claim 9, wherein the curve of the convex folding shoulders (14, 15) is independent of a turnover width (7*a*, 7*b*) of the strip of packaging material.

15. A packaging apparatus according to claim 14, wherein an initial angle ($\alpha$,$\beta$) of the folding shoulder (14, 15) with respect to the front face (12) increases according as the turnover width (7*a*, 7*b*) of the strip of packaging material (7) is greater.

16. In a method for folding into a shell a continuous strip of packaging material comprising guiding the packaging material from an underside in a feeding direction over a folding element so as to form a shell from the material strip, guiding the shell from the folding element in a product conveying direction, and placing products to be packaged on the material strip between folded sides of the material strip, the improvement wherein the folding element (1) comprises a front face (12) extending in the feeding direction and a top face (17) extending in the product conveying direction, the top face (17) of the folding element (1) lying in a plane parallel to a product conveying plane, the front face (12) extending perpendicularly to the product conveying direction, and the front face (12) being bounded on opposite sides by a fold forming edge (13) which intersects an intersecting line between the front and top faces (12, 17) in a folding point where folds are formed in the material strip (7).

* * * * *